US007862861B2

(12) United States Patent
Kito

(10) Patent No.: US 7,862,861 B2
(45) Date of Patent: Jan. 4, 2011

(54) METHOD OF MANUFACTURING INFORMATION RECORDING MATERIALS, AND INFORMATION RECORDING MATERIALS

(75) Inventor: Hirokazu Kito, Fujinomiya (JP)

(73) Assignee: Fujifilm Corporation, Tokyo (JP)

( * ) Notice: Subject to any disclaimer, the term of this patent is extended or adjusted under 35 U.S.C. 154(b) by 937 days.

(21) Appl. No.: 11/597,503

(22) PCT Filed: May 23, 2005

(86) PCT No.: PCT/JP2005/009340

§ 371 (c)(1),
(2), (4) Date: Nov. 24, 2006

(87) PCT Pub. No.: WO2005/113162

PCT Pub. Date: Dec. 1, 2005

(65) Prior Publication Data

US 2007/0243344 A1 Oct. 18, 2007

(30) Foreign Application Priority Data

May 24, 2004 (JP) ..... 2004-153608

(51) Int. Cl.
*B41M 5/00* (2006.01)
*B05D 3/00* (2006.01)

(52) U.S. Cl. ..... 427/372.2; 427/407.1; 428/32.1

(58) Field of Classification Search ..... 427/407.1, 427/372.2

See application file for complete search history.

(56) References Cited

U.S. PATENT DOCUMENTS 6,682,788 B2 * 1/2004 Saito et al. ..... 428/32.34
6,777,039 B2 * 8/2004 Koike et al. ..... 428/32.26
7,014,311 B2 * 3/2006 Kobayashi et al. ..... 347/102
2003/0190432 A1 10/2003 Yokota et al.

FOREIGN PATENT DOCUMENTS

| | | | |
|---|---|---|---|
| JP | 11-48603 | A | 2/1999 |
| JP | 2000-27093 | A | 1/2000 |
| JP | 2003-145929 | A | 5/2003 |
| JP | 2004-50785 | A | 2/2004 |
| WO | WO 01/76884 | A1 | 10/2001 |

OTHER PUBLICATIONS

The International Bureau of WIPO, Notification of Transmittal of Translation of the International Preliminary Report on Patentability, International Filing Date: May 23, 2005, Geneva, Switzerland, International Application No. PCT/JP2005/009340, pp. 1-6.

* cited by examiner

*Primary Examiner*—Michael Kornakov
*Assistant Examiner*—Ryan Schiro
(74) *Attorney, Agent, or Firm*—Sughrue Mion, PLLC

(57) ABSTRACT

Normal simultaneous multi-layer coating can be accomplished without allowing the coating liquids to increase in viscosity before and during their application, and inter-layer mixing can be prevented by increasing the viscosity after the application. In a method of manufacturing an information recording material in which at least one out of a plurality of layers formed by simultaneous multi-layer application of a plurality of coating liquids over a running supporting base 14 with a slide bead coating device 16 is an information recording layer, and the multi-layer coats so formed are dried by a drying device 20, at least one of the plurality of coating liquids contains PVA and boric acid whose mutual contact or mixing causes the coating liquids to increase in viscosity.

11 Claims, 4 Drawing Sheets

METHOD OF MANUFACTURING INFORMATION RECORDING MATERIALS, AND INFORMATION RECORDING MATERIALS

TECHNICAL FIELD

The present invention relates to a method of manufacturing information recording materials and information recording materials, and more particularly, to an information recording material manufacturing method of manufacturing information recording materials such as a thermosensitive recording material using a simultaneous multi layer applying method, an inkjet recording material and so forth, and information recording materials manufactured by that manufacturing method.

BACKGROUND ART

Information recording materials having an information recording layer for recording information on a supporting base include pressure-sensitive recording materials, thermosensitive recording materials, photosensitive thermosensitive recording materials, photosensitive pressure-sensitive recording materials and inkjet recording materials. Such information recording materials, having the advantages of allowing the use of a relatively simple device, maintenance ease and the absence of noise emission, are extensively used in measuring and recording instruments, facsimile machines, printers, computer terminals, labeling devices, ticket vending machines and so forth.

In recent years, enhanced functions and performances of these information recording materials have come to be required, and to meet this requirement materials having a multi-layer coats consisting of two or more coats over a supporting base are now used. For instance, with a view to achieving superior color optical density, sensitivity and image stability together with a plurality of tints, information recording materials consisting of multiple coats have come into practical use, including ones in which one or more protective layers are disposed over the information recording layer, ones in which an undercoat is laid between the supporting base and the information recording layer, ones in which both a protective layer and an undercoat are provided, and one in which two or more information recording layers, instead of only one, are disposed.

In a conventional method of manufacturing information recording materials having multi-layer coats consisting of two or more coats over the supporting base, one coat is applied and dried at a time over the supporting base in a consecutive coating process, and the coating procedures used include air knife coating,. blade coating, rod coating and reverse roll coating. However, information recording materials manufactured by any such consecutive coating process are poor in. coat quality, involving such problems low productivity due to the large number of times of coating in addition to the infiltration of the upper coat liquid into the lower coat or coats, pin holes in the upper coat due to bursts during the application of the upper coat and unevenness in coat quality arising while coats are applied consecutively over a long time.

On the other hand, while in the field of photosensitive materials for photographic use simultaneous multi-layer coating processes, such as curtain coating and slide bead coating, in which multi-layer coats are formed by applying a plurality of coating liquids are applied at the same time, are employed. The reason for this practice is that coating liquids for photosensitive materials for photographic use contain gelatin as a binder, which can be gelled by cooling immediately after the coating liquid is applied over the supporting base. In this way, immobilization of the coating liquid by gelatin even enables the simultaneously applied multi-layer coats to be dried and fixed without allowing the layer configuration to be disturbed by inter-layer mixing.

However, the use of a simultaneous multi-layer coating process for the manufacture of thermosensitive recording materials, which are a type of information recording material not permitting the use of gelatin because of its thermal coloring property, involves a problem that it would invite inter-layer mixing between the layers of the multi-layer coats and cannot provide adequate performance as thermosensitive recording materials. Also, the use of a simultaneous multi-layer coating process for the manufacture of ink jet recording materials, which use no gelatin to secure the absorptiveness and absorbing velocity of ink, involves a problem that it would invite inter-layer mixing between the layers of the multi-layer coats and cannot provide adequate performance as ink jet recording materials.

Patent Document 1 proposes a manufacturing method for information recording materials which do not permit addition of gelatin to coating liquids, which prevents the occurrence of inter-layer mixing even if a curtain coating process, one of simultaneous multi-layer coating processes is used.

Patent Document 1 proposes to prevent inter-layer mixing by curtain-applying a plurality of coating liquid films with an intermediate coating liquid film being disposed between two coating liquid films to separate the films whose viscosity is increased when they come into contact or are mixed with each other. Patent Document 1 also proposes to prevent inter-layer mixing by utilizing the increase in viscosity over time resulting from the mutual contact or mixing of at least one pair of two adjacent layers constituting a multi-layered coating liquid film. And as a specific example of gradually increasing the viscosity over time when the two coating liquids are brought into contact or mixed with each other, a combination of emulsion of a polymer containing carboxyl groups, which react with alkali to be dissolved, with alkali is cited.

Or in ink jet recording materials which are obtained by coating polyethylene laminate paper with an ink-receptive layer, usually coating of 100 μm or greater wet thickness is required, and this involves a problem of taking a long time to dry and, on account of susceptibility to irregularities in coating due to uneven distribution of liquid during the drying, a lack of uniformity in the coating.

As a way to solve these problems, for instance Patent Document 2 proposes a method of manufacturing an ink jet recording material which uses a polymer material having a property to increase in viscosity at low temperature, and to dry this polymer after it is set by being caused to pass a cooling zone.

Patent Document 1: WO01/076884

Patent Document 2: Japanese Patent Application Laid-Open No. 2004-50785

DISCLOSURE OF THE INVENTION

However, the method of manufacturing an information recording material by disposing an intermediate coating liquid film between two coating liquid films to separate the film proposed in Patent Document 1, requires a thick enough intermediate coating film to isolate the two coating films, resulting in a disadvantage of an increased quantity of wet coating and accordingly lower productivity.

Also, the method of preventing inter-layer mixing by the increase in viscosity over time when at least two adjoining ones constituting a multilayered coating film at proposed in Patent Document 1 involves a disadvantage of incapability of sufficient layer separation because inter-layer mixing progresses while the viscosity is increasing over time. Accelerating the viscosity increase to avoid this disadvantage would invite a problem of high viscosity of the coating liquid in the curtain film, which would be detrimental to the stability of coating.

Furthermore, curtain coating to be used according to Patent Document 1, though it is a coating method suitable for high speed application, there are strict limitations regarding the physical properties of the coating liquid and its application quantity, while slide bead coating has an advantage that it is less limited than curtain coating in the physical properties of the coating liquid and its application quantity, and is frequently used for the production of thermosensitive recording films and ink jet recording paper that provides a photographic quality. However, in slide bead coating, since a plurality of coating liquids are stacked one over another on the slide surface before the supporting base is coated with the liquids, where contact or mixing between adjoining layers invites an increase in viscosity, this viscosity will arise in the coating process to prevent normal coating unless the progress of viscosity increase can be controlled even more accurately than in curtain coating. Furthermore, after the application when the increased viscosity is needed to prevent inter-layer mixing, there will arise a problem that the viscosity does not increase in the drying stage for instance.

Or where coating liquids which greatly vary in viscosity with the temperature are to be used as disclosed in Patent Document 2, especially where a slide bead coater or a curtain coater is to be used for application, even a slight temperature variation in the application head would vary the viscosity and deteriorate the profile of the coating quantity in the widthwise direction, and accordingly there is a problem that very strict temperature control is required.

An object of the present invention, attempted in view of these circumstances, is to provide a method of manufacturing information recording materials which permit normal simultaneous multi-layer coating without allowing the coating liquids to increase in viscosity before and during their application and prevention of inter-layer mixing by increasing the viscosity after the application, therefore making it possible to manufacture the information recording materials excellent in functions and performance and also permitting the use of slide coating, and an information recording material manufactured by that manufacturing method.

In order to achieve the object stated above, a method of manufacturing an information recording material, according to a first aspect of the invention, having a coating step of forming multi-layer coats, of which at least one of the plurality of layers formed by simultaneous multi-layer application of a plurality of coating liquids over a running supporting base is an information recording layer, and a drying step of drying the multi-layer coats formed at the coating step is characterized in that at least one coating liquid out of the plurality of coating liquids contains a plurality of components which, when brought into contact or are mixed with each other, make the coating liquids increase in viscosity.

According to the first aspect of the invention, the presence in at least one coating liquid out of the plurality of coating liquids constituting the multi-layer coats of a plurality of components which, when brought into contact or are mixed with each other, make the coating liquids increase in viscosity serves to prevent inter-layer mixing, which is mutual mixing of layers constituting the multi-layer coats. Therefore, as there is no need as in Patent Document 1 to dispose an intermediate layer to prevent inter-layer mixing, the manufactured information recording material can be reduced in thickness.

Where a plurality of components which, when brought into contact or are mixed with each other, make the coating liquids increase in viscosity, are contained, it is necessary to prevent the viscosity from increasing at the coating step so that the viscosity is increased after the application of coats.

A second aspect of the invention is characterized in that, in the first aspect, the plurality of components react with each other and increase in viscosity by being brought into contact or mixed with each other and the reaction is a thermal reversible reaction.

If the reaction between the components for increasing the viscosity is a thermal reversible reaction, the prevention of viscosity increase at the coating step and the viscosity increase after the application of coating can be easily controlled by varying the temperature of the coating liquids before and during the application and the temperature of the multi-layer coats after the application. Possible combinations of components in the thermal reversible reaction for increasing the viscosity include, for instance, one of PVA and boric acid. The film hardening reaction between PVA and boric acid is a thermal reversible reaction, by which a film hardening reaction significantly progresses at a low temperature of below 25° C. Therefore, coating can be normally applied by keeping the temperature of the coating liquids at or above 25° C. before and during the application to prevent the coating liquids from increasing in viscosity, and inter-layer mixing can be prevented by once lowering the temperature of the coating liquids to below 25° C. after the application and thereby making the film hardening reaction progress. Incidentally, the reaction for increasing the viscosity may be achieved by any combination of components capable of thermal reversible reaction, but not limited to the combination of PVA and boric acid.

A third aspect of the invention is characterized in that, in the first or second aspect, the viscosity increase by the plurality of components is a film hardening reaction by polyvinyl alcohol (PVA) and boric acid.

In the third aspect, the reaction for increasing the viscosity uses a combination of PVA and boric acid as components capable of thermal reversible reaction, and coating liquids containing PVA and boric acid are not only capable of thermal reversible reaction, but also permit accurate control of the progress of the film hardening reaction, including stop or acceleration of the progress, by appropriately setting the pH of the coating liquids and the concentrations of PVA and boric acid in the coating liquids. Therefore, the control to prevent the viscosity from increasing at the coating step and facilitating the increase in viscosity after the coating application can be accomplished easily and highly accurately.

A fourth aspect of the invention is characterized in that, in the third aspect, the pH of coating liquids containing the polyvinyl alcohol (PVA) and boric acid is 6.5 or less and the pH of the coating liquids of any layer adjoining to any layer formed of these coating liquids is no less than 7.

This is because the film hardening reaction between PVA and boric acid is difficult to progress in the acid pH range; adding the pH control of the coating liquids to the temperature control of the coating liquids makes possible more accurate control of the film hardening reaction. Incidentally, it is even more preferable for the pH of the coating liquids containing PVA and boric acid to be 6 or less.

A fifth aspect of the invention is characterized in that, in the third or fourth aspect, the concentration of polyvinyl alcohol (PVA) relative to the coating liquids is in the range of 3 to 20 wt % and the concentration of the boric acid is in the range of 0.5 to 10 wt % relative to the polyvinyl alcohol (PVA).

This is because the film hardening reaction between PVA and boric acid after the coating application is difficult to take place in the lower PVA and boric acid concentration range than the aforementioned lower limit (3 wt % for PVA relative to the coating liquids and 0.5 wt % for boric acid relative to PVA), and an undesirable state of coating liquids, namely gelation or aggregation, is more likely to occur before and during their application in the higher range than the aforementioned higher limit (20 wt % for PVA relative to the coating liquids and 10 wt % for boric acid relative to PVA). Therefore, adding the concentration control of PVA and boric acid to the temperature control of the coating liquids and the pH control of the coating liquids makes possible more accurate control of the film hardening reaction.

The PVA concentration in this context is the weight of the solid PVA content/the weight of the coating liquids, and the boric acid concentration is the weight of boric acid/the weight of the solid PVA content.

A sixth aspect of the invention is characterized in that, in any of the third through fifth aspects, the polyvinyl alcohol (PVA) is partly saponified. This is because fully saponified PVA is easily subjected to film hardening reaction with boric acid and accordingly is easier to invite gelation or aggregation before and during coating application. Incidentally, there is no problem with using fully saponified polyvinyl alcohol in any layer adjoining layers containing PVA and boric acid. Therefore, addition of the use of partly saponified PVA to the temperature control of the coating liquids, the pH control of the coating liquids and the concentration control of PVA and boric acid makes possible more accurate control of the film hardening reaction.

A seventh aspect of the invention is characterized in that, in any of the third through sixth aspects, the viscosity of coating liquids containing the polyvinyl alcohol (PVA) and boric acid and the viscosity of any layer adjoining the layers formed of these coating liquids at the liquid temperature at the time of applying the coating liquids are 50 mPa-s or more. This is because low viscosities of the coating liquids containing PVA and boric acid and the coating liquids of any adjoining layer would make it impossible to achieve a sufficient effect to prevent inter-layer mixing. Incidentally, preferably the viscosities should be 100 mPa-s or more, more preferably 200 mPa-s or more. Therefore, addition of the viscosity control of the coating liquids to the temperature control of the coating liquids, the pH control of the coating liquids, the concentration control of PVA and boric acid and the use of partly saponified PVA makes possible more accurate control of the film hardening reaction.

An eighth aspect of the invention is characterized in that, in any of the third through seventh aspects, the coating liquids containing the polyvinyl alcohol (PVA) and boric acid are applied with their liquid temperature kept at 25° C. to 45° C. This is because the film hardening reaction between PVA and boric acid is more likely to occur at a lower temperature and, if the temperature of the coating liquids applied is less than 25° C., gelation will occur before and during their application, making it impossible to form multi-layer coats of high quality. On the other hand, if the temperature of the coating liquids is too high as more than 45° C., aggregation will occur, also making it impossible to form multi-layer coats of high quality.

A ninth aspect of the invention is characterized in that, in any of the first through eighth aspects, the process of the simultaneous multi-layer application is a slide bead coating process.

This because the slide bead coating process has an advantage that it is less limited than curtain coating in the physical properties of the coating liquids and their application quantity, making it possible to form multi-layer coats of high quality.

A tenth aspect of the invention is characterized in that, in the ninth aspect, the application head of the slide bead coating process is kept at a temperature of 25° C. to 45° C.

Although it will become impossible in the slide bead coating process to perform normal coat application if a film hardening reaction occurs when a coating liquid is ejected from a slit onto the slide surface and when a plurality of coating liquids forming a layer flow down the slide surface, keeping the application head at a temperature of 25° C. to 45° C. makes it possible to prevent any film hardening reaction from occurring before and during their application.

An eleventh aspect of the invention is characterized in that, in any of the third through tenth aspects, a setting step to keep the temperature of the multi-layer coats below 25° C. for five seconds or more is performed between the coating step and the drying step.

The film hardening reaction between PVA and boric acid is a reaction that occurs more significantly at a lower temperature, but hardly occurs at a high temperature. Therefore, by once reducing the temperature of the multi-layer coats to less than 25° C. and letting the film hardening reaction progress after the application, inter-layer mixing can be prevented more effectively at the subsequent drying step.

A twelfth aspect of the invention is characterized in that, in any of the third through eleventh aspects, the temperature of the multi-layer coats is kept at 45° C. or below until the water content in the multi-layer coats falls to 80% or below of the level at the time of coat application.

This is because, since the film hardening reaction between PVA and boric acid is a thermal reversible reaction, even if film hardening is allowed to occur by once reducing the temperature to a low level, raising the temperature again causes softening to occur to facilitate inter-layer mixing. Therefore, it is necessary to prevent inter-layer mixing by keeping the temperature of the multi-layer coats at 45° C. or below until the water content in the multi-layer coats evaporates, resulting in an increased concentration of solid contents, and the PVA concentration and the boric acid concentration in the multi-layer coats also rise to cause a stronger film hardening reaction to take place to substantially eliminate the fluidity of the multi-layer coats. This can be achieved by appropriately controlling the temperature of the drying air and the dew point of the drying air at the drying step.

In order to achieve the object stated above, a method of manufacturing an information recording material according to a thirteenth aspect of the invention, having a coating step of forming multi-layer coats, of which at least one of a plurality of layers formed by simultaneous multi-layer application of a plurality of coating liquids over a running supporting base is an information recording layer, and a drying step of drying the multi-layer coats formed at the coating step, is characterized in that PVA is contained in one of the coating liquids constituting adjoining layers out of a plurality coating liquids forming the multi-layer coats and boric acid is contained in the other coating liquid.

While the first through twelfth aspects described above are characterized in that all of the plurality of components which when coming into contact or being mixed each other increase in viscosity, for instance both PVA and boric acid, are in contained in the coating liquids constituting at least one layer of the multi-layer coats, the thirteenth aspect is characterized in that PVA is contained in one of the coating liquids constituting any adjacent layer out of the multi-layer coats and boric acid is contained in the other coating liquid.

According to the thirteenth aspect above, inter-layer mixing can be eliminated by causing a film hardening reaction to take place on the interface between the coating liquid containing PVA and the coating liquid containing boric acid. In this case again, occurrence of a film hardening reaction on the interface before or during coating application would make normal application impossible. Therefore, in the thirteenth aspect, too, it is preferable to perform precise control to prevent any film hardening reaction from occurring before or during coating application by the temperature control of the coating liquids, the pH control of the coating liquids, the concentration control of PVA and boric acid, the use of partly saponified PVA coating liquids and the viscosity control of the coating liquids, so that the film hardening reaction occurs after the coating application as well.

A fourteenth aspect of the invention is characterized in that it is an information recording material manufactured by any of the information recording material manufacturing methods according to any of the first through thirteenth aspects, in a fifteenth aspect of the invention the information recording material is a thermosensitive recording material and in a sixteenth aspect of the invention the information recording material is an ink jet recording material.

In this way, information recording materials manufactured by any information recording material manufacturing method according to the present invention can be reduced in the thickness of the information recording material and, even in a coating process in which layers overlap with one another before coating application such as the slide bead application, simultaneous multi-layer application can be realized without allowing inter-layer mixing to occur; therefore an information recording material excellent in functions and performance can be obtained.

As hitherto described, by the method of manufacturing information recording materials according to the invention, simultaneous multi-layer coating can be accomplished normally without allowing the coating liquids to increase in viscosity before and during their application, and inter-layer mixing can be prevented by increasing the viscosity after the application.

Therefore information recording materials manufactured by the information recording material manufacturing method according to the invention are less in material thickness, and information recording materials excellent in functions and performance can be obtained.

| Description of Symbols | |
|---|---|
| 10 | Information recording material manufacturing apparatus |
| 12 | Feed-out device |
| 14 | Supporting base |
| 16 | Coating device |

-continued

| Description of Symbols | |
|---|---|
| 18 | Set zone device |
| 20 | Drying device |
| 22 | Take-up device |
| 24 | Coating head |
| 26 | Backup roller |
| 28,30,32 | Manifolds |
| 36,38,40 | Slits |
| 44 | Sliding face |
| 46 | Lip tip |
| 48 | Guide plate |
| 50 | Gap |
| 52a | Horizontal channel |
| 52b | Vertical channel |
| 54 | Piping |
| 60 | Liquid feed line |
| 62 | Liquid feed tank |
| 64 | Liquid feed piping |
| 66 | Ultrasonic defoaming device |
| 68 | Liquid feed pump |
| 70 | Filter |
| 72 | Heat exchanger |
| 81 | Flowmeter |
| 82 | Bubble detector |

BEST MODES FOR CARRYING OUT THE INVENTION

A method of manufacturing information recording materials and information recording materials thereby manufactured according to the present invention will be described below in their best modes for implementation with reference to the accompanying drawings.

Figure 1:
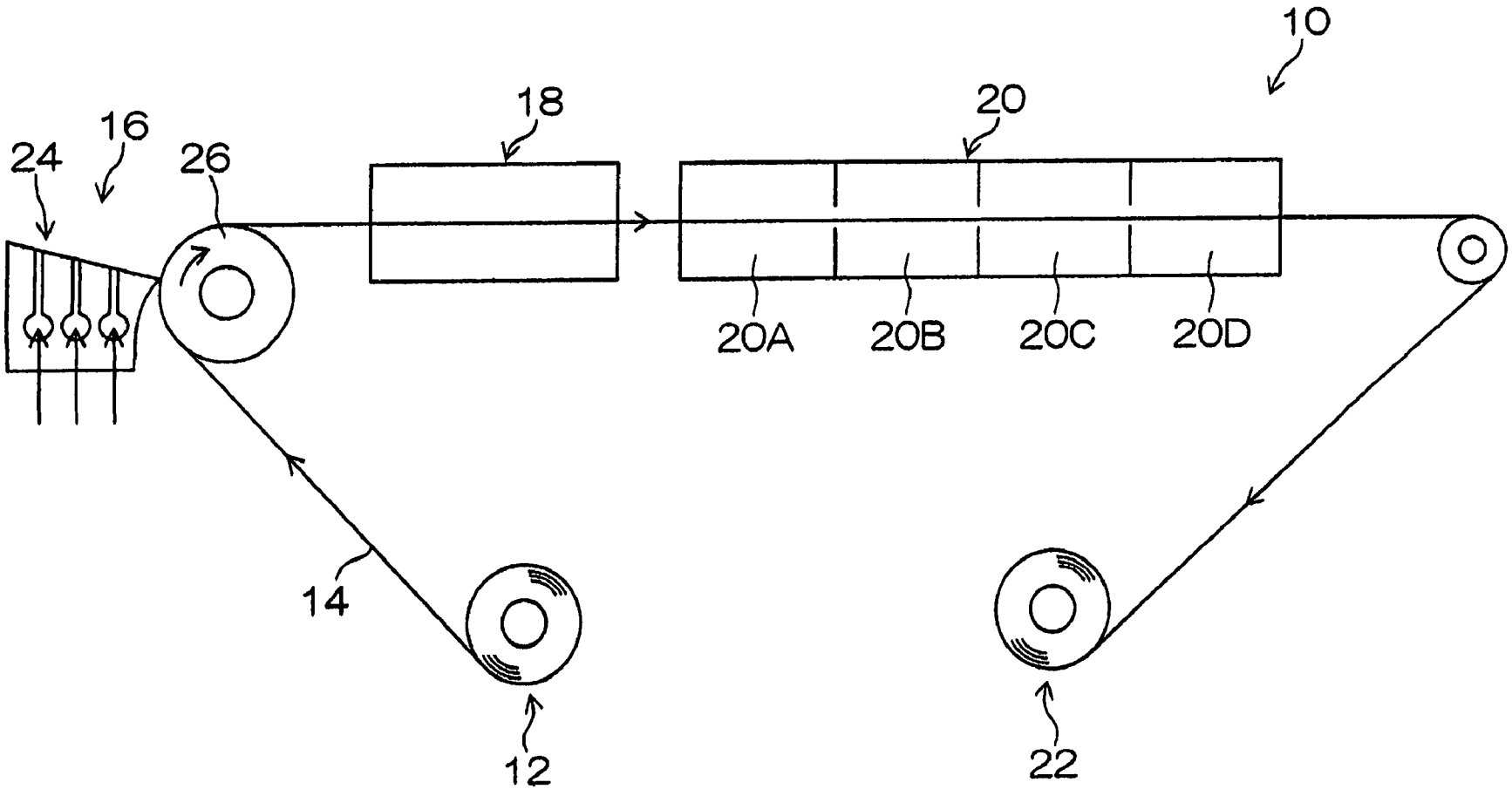
FIG. 1 is an overall configurational diagram showing an example of manufacturing apparatus 10 for implementing the method of manufacturing information recording materials according to the invention.

FIG. 1 is an overall configurational diagram showing an example of manufacturing apparatus 10 for implementing the method of manufacturing information recording materials according to the invention.

As shown in FIG. 1, a plurality of coating liquids constituting a plurality of layers of an information recording material are simultaneously applied in multiple layers by a coating device 16 to form multi-layer coats over a supporting base 14 which is fed out of a feed-out device 12 and continuously runs and, after the multi-layer coats are set at low temperature by a set zone device 18, then dried by a drying device 20. The information recording material is manufactured, and the manufactured information recording material is taken up by a take-up device 22. The coating liquids to constitute the plurality of layers of the information recording material here are not limited in particular, but for the thermosensitive recording materials for instance a coating liquid for the thermosensitive recording layer, a coating liquid for the light reflecting layer and a coating liquid for the protective layer can be used; for the ink jet recording paper, a coating liquid for the undercoat layer, at least one or more kinds of coating liquids for the color material receptive layer and a coating liquid for the protective layer can be used. According to the invention, a plurality of components which make the coating liquid increase in viscosity when they come into contact or become mixed with each other, such as PVA and boric acid for instance, are contained in at least one of the plurality of coating liquids, or PVA is contained in one of the plurality of coating liquids constituting adjoining layers and boric acid is contained in the other coating liquid.

The following description will refer to a case in which three layers are simultaneously coated in multiple layers to manufacture the information recording material and PVA and boric acid are contained in the coating liquid constituting one of the three layers.

While the coating device 16 may be any device capable of simultaneously applying multiple layers, and for instance a slide bead coating device or a slide curtain coating device can be used, the slide bead coating device shown in FIG. 1 can be suitably used. This is because since the slide bead coating process has an advantage of being less limited than curtain coating in the physical properties of coating liquids and their quantity, multi-layer coats of higher quality can be formed.

Figure 2:
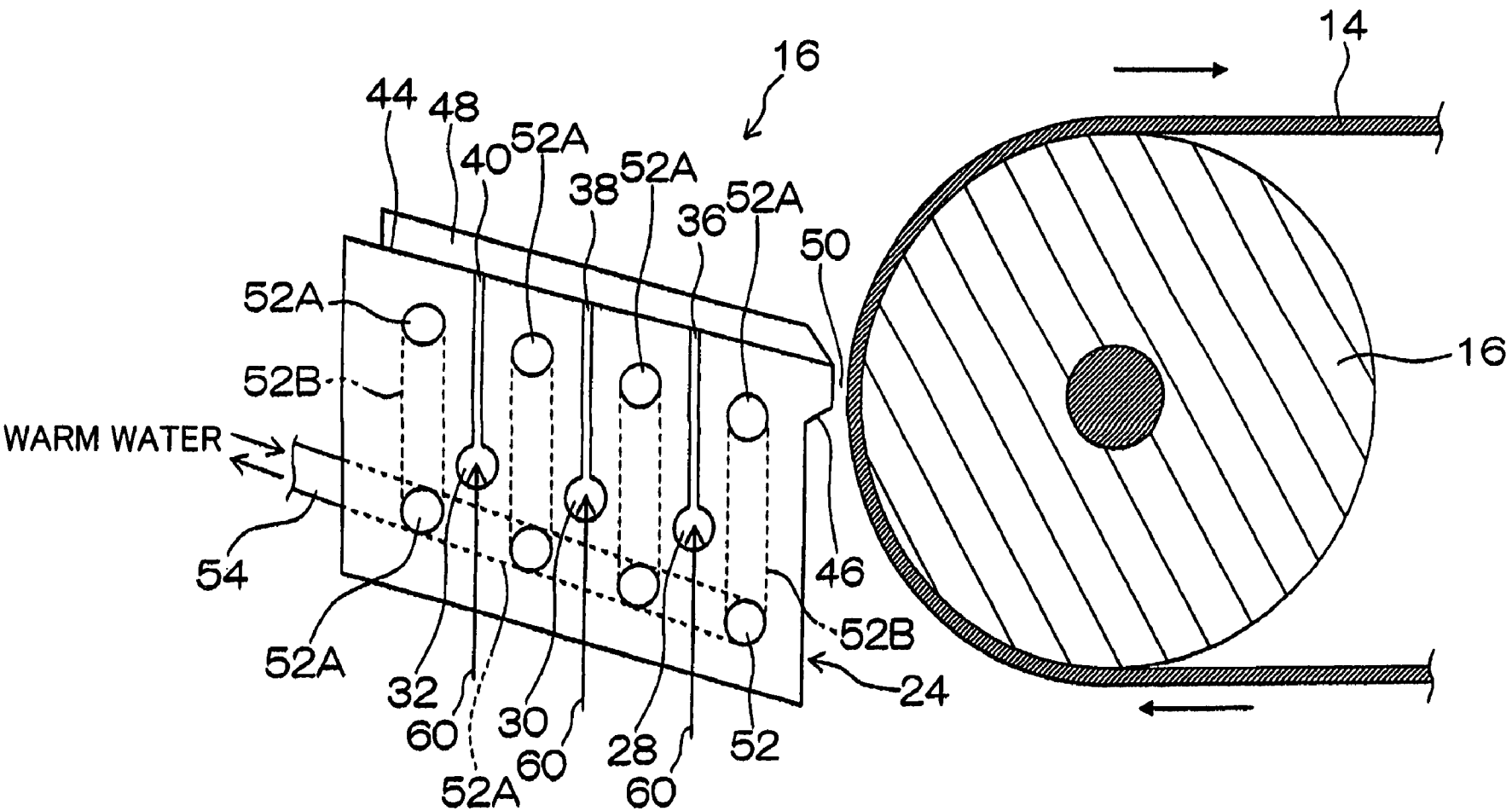
FIG. 2 is a profile of a slide bead coating device.
Figure 3:
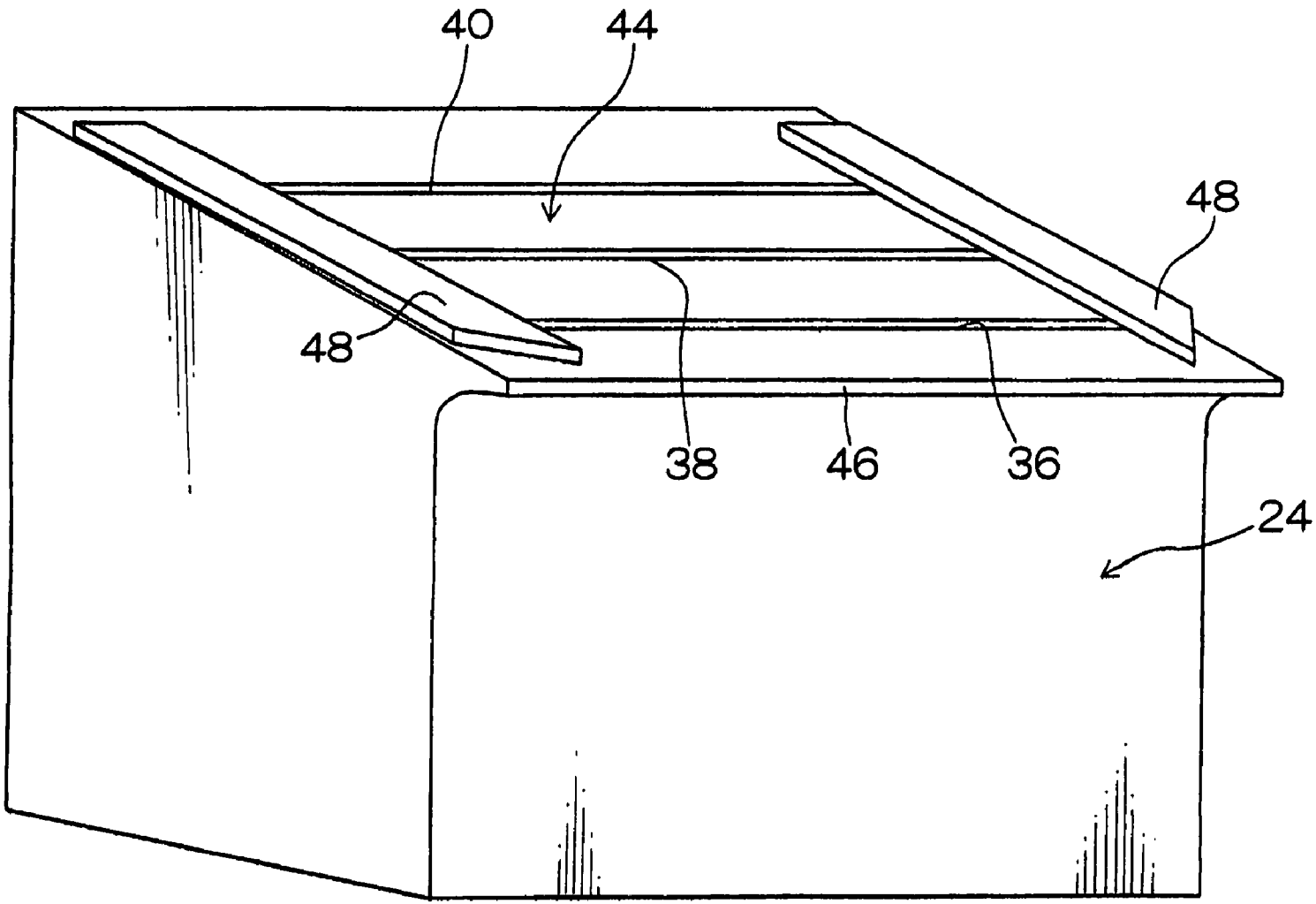
FIG. 3 is a perspective view of the slide bead coating device.

FIG. 2 is a sectional profile of a slide bead coating device 16, and FIG. 3 is a perspective view of a coating head 24.

As shown in FIG. 2 and FIG. 3, the slide bead coating device 16 is mainly composed of the coating head 24 and a backup roller 26 around which the continuously running supporting base 14 is wound to be supported. Within the block constituting the coating head 24 three manifolds 28, 30 and 32 which expand, in the widthwise direction of the supporting base 14, the flows of coating liquids fed from a liquid feed line 60 to be described afterwards are formed, and three narrow slits 36, 38 and 40 communicating with these manifolds 28 through 32 are formed until a sliding face 44. This sliding face 44 is formed on the upper face of the coating head 24, and inclined downward toward the backup roller 26. And the coating liquids supplied to the manifolds 28 through 32 are forced out onto the sliding face 44 via the slits 36 through 40, successively overlap one another while flowing down the sliding face 44 to form multi-layer coats, and reaches the lip tip 46 at the lower end of the sliding face 44 without mixing each other. This flow of the coating liquids down the sliding face 44 is guided by a pair of guide plates 48 and 48 arranged in parallel at the two ends of the sliding face 44. The coating liquids having reached the lip tip 46 form coating liquid beads in a gap 50 between the lip tip 46 and the face of the supporting base 14 running wound around the backup roller 26, and are applied over the face of the supporting base 14 via these coating liquid beads.

Also within the block constituting the coating head 24, a plurality of transverse channels 52A, 52A . . . and a plurality of longitudinal channels 52B, 52B . . . in which adjusts warm water flows the temperature of coating liquids flowing up the slits 36 through 40 and coating liquids flowing down the sliding face 44 are formed as a single continuous channel. And these channels 52A and 52B constitute a circulation system together with a warm water supply device, not shown via a warm water piping 54, and warm water of a constant temperature in a range of 25° C. to 45° C. is circulated between the channels 52A and 52B and the warm water supply device. The coating head 24 is thereby kept at the constant temperature in the range of 25° C. to 45° C.

The set zone device 18 is intended to prevent inter-layer mixing by accelerating the film hardening reaction between PVA and boric acid after the coat application. This is because inter-layer mixing can be more effectively prevented subsequently in the drying device 20 by accelerating the film hardening reaction between PVA and boric acid by once reducing the temperature of the multi-layer coats to below 25° C. after their application, since this is a reaction taking place significantly at lower temperature but hardly occurring at high temperature.

The set zone device 18, structurally similar to the drying device, has to be equipped with a blower/exhaust device capable of keeping the temperature of the multi-layer coats to below 25° C. and controlling the film surface air flow rate to not more than 5 m/second so as not to disturb the coats in which the film hardening reaction has not yet sufficiently taken place. Since the film hardening advances in a short period of about five seconds at a low temperature of 10° C. or below, the length of the set zone can be kept short. However, as the film hardening can advance even at 25° C. if a sufficient time is given, there is no need to deliberately blow cold air, but drying of the coats with a warm air flow of 30 to 40° C. can cause the film hardening reaction to progress at the same time.

As the drying device 20, what has a structure of being split into a plurality of drying zones, each of which allows setting to different drying conditions as shown in FIG. 1 can be suitably used, though it is not particularly limited thereto. Here, the drying device 20 is supposed to be split into four drying zones, and these drying zones will be referred to as a first drying zone 20A, a second drying zone 20B, a third drying zone 20C and a fourth drying zone 20D from the upstream side of the running direction of the supporting base. And drying is performed with the temperature of the multi-layer coats kept at 45° C. or below in the former half of the drying zones and, in the latter half of the drying zones where the water content in the multi-layer coats falls to 80% or less of its level at the time of application, drying is performed at relatively high temperature, for instance around 80° C. to bring the water content in the multi-layer coats to its target level. This is because, since the film hardening reaction between PVA and boric acid is a thermal reversible reaction, even if the film is hardened by once reducing the temperature of the multi-layer coats to a low level in the set zone device 18, raising the temperature again in the drying device 20 softens the multi-layer coats and facilitates inter-layer mixing. Therefore, until the water content in the multi-layer coats evaporates to thereby increase the solid, concentration and in addition the PVA concentration and the boric acid concentration also rise to cause a stronger film hardening reaction to occur and the fluidity of the multi-layer coats substantially disappears, inter-layer mixing should be prevented by keeping the temperature of the multi-layer coats at 45° C. or below in the drying device 20.

Figure 4:
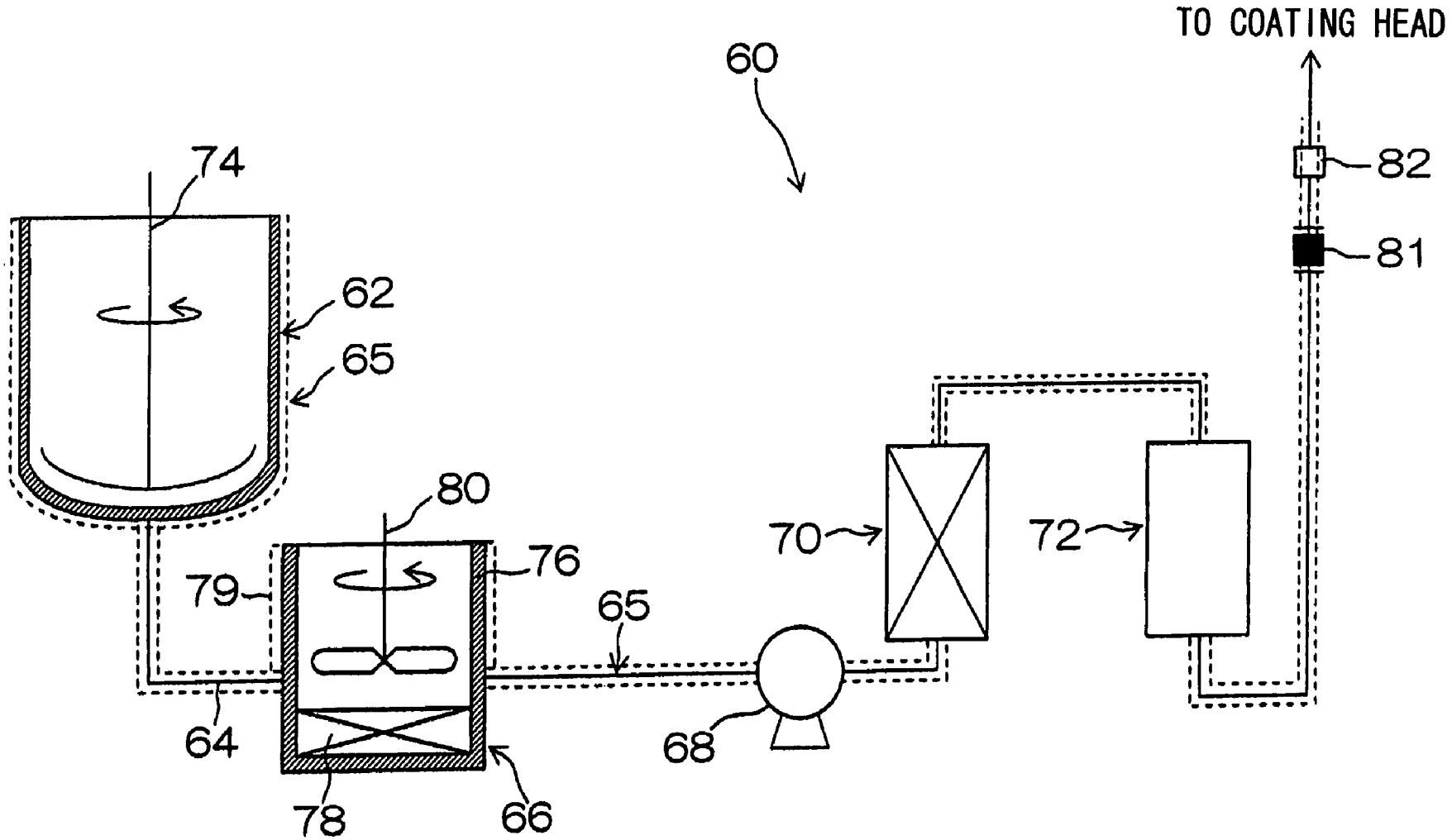
FIG. 4 is a configurational diagram of the liquid feed line.

FIG. 4 is a configurational diagram outlining the liquid feed line 60, which feeds the coating head 24 with coating liquids. There are provided as many liquid feed lines as the number of coating liquids, but the liquid feed line 60 for the coating liquid containing PVA and boric acid will be described here.

The liquid feed line 60 is a line which feeds coating liquids in a liquid feed tank 62 to the coating head 24 by way of a liquid feed piping 64, and is mainly composed of the liquid feed tank 62 for temporarily storing coating liquids dispensed in a liquid dispensing tank, not shown, an ultrasonic defoaming device 66 open to the atmosphere, a liquid feed pump 68, a filter 70 and a heat exchanger 72. Regarding the liquid feed tank 62 and the liquid feed piping 64, coating liquids, which are to be supplied from the liquid feed tank 62 to the coating head 24 and whose temperature is kept in the range of 25° C. to 45° C. by a heat insulating jacket 65 (indicated by broken lines in FIG. 4), are supplied to the coating head 24, and are adjusted in temperature by the heat exchanger 72 in the range of 25° C. to 45° C. This is because the film hardening reaction between PVA and boric acid is more likely to occur at a lower temperature and, if the temperature of the coating liquids to be applied is less than 25° C., gelation will occur before their application (for instance when the coating liquids are being fed by the liquid feed line 60) and during their application (when they are being applied by the coating head 24 to the supporting base 14), making it impossible to form multi-layer coats of high quality. On the other hand, if the temperature of the coating liquids is too high as more than 45° C., aggregation will occur, also making it impossible to form multi-layer coats of high quality.

Further, it is preferable for the pH of the coating liquids containing PVA and boric acid to be adjusted to 6.5 or below in the liquid feed tank 62. This is because the film hardening reaction between PVA and boric acid is difficult to progress in the acid pH range, and the viscosity increase of the coating liquids to obstruct normal coat application before and during their application can be thereby prevented. Incidentally, it is more preferable for the pH of the coating liquids containing PVA and boric acid to be 6 or below. In this case, it is preferable for the pH of the coating liquids of the layers adjoining the coating liquids containing PVA and boric acid to be 7 or above.

It is further preferable, in the liquid feed tank 62, for the concentration of PVA relative to the coating liquids to be in the range of 3 to 20 wt % and the concentration of boric acid to be in the range of 0.5 to 10 wt % relative to PVA. This is because, if the concentration of PVA and boric acid is lower than the aforementioned lower limit (3 wt % for PVA relative to the coating liquids and 0.5 wt % for boric acid relative to PVA), it is difficult for the film hardening reaction after the coat application to occur, or if the concentration is higher than the aforementioned higher limit (20 wt % for PVA relative to the coating liquids and 10 wt % for boric acid relative to PVA), an undesirable state of coating liquids, namely gelation or aggregation, is more likely to occur before and during their application. In this case, it is preferable for PVA to be partly saponified. This is because fully saponified PVA would more easily react with boric acid and accordingly be easier to invite an undesirable state of coating liquids, namely gelation or aggregation before and during coat application. Incidentally, there is no problem with using fully saponified polyvinyl alcohol in any layer adjoining layers containing PVA and boric acid.

Further, it is preferable for the viscosity of the coating liquids containing PVA and boric acid in the liquid feed tank 62 to be 50 mPa-s or more and eventually for the viscosity of the coating liquids at the liquid temperature of their application from the coating head 24 to be 50 mPa-s or more. In this case, the viscosity of the coating liquids of any layer adjoining the layer formed by the coating liquids containing PVA and boric acid is 50 mPa-s or above. This is because a low viscosity of the coating liquids containing PVA and boric acid and of the coating liquids of any layer adjoining, no sufficient effect to prevent inter-layer mixing can be achieved. Incidentally, it is preferable for the viscosity to be 100 mPa-S or more and particularly preferable to be 200 mPa-s or more.

The coating liquids stocked in the liquid feed tank 62 are uniformized by stirring with a stirrer 74, and delivered by the liquid feed pump 68 first to the ultrasonic defoaming device 66 open to the atmosphere in response to coating operation. As the liquid feed pump 68, a pressure-feed type non-pulsating pump which generates no foam, such as a diaphragm type or a plunger type unit, can be suitably used.

The ultrasonic defoaming device 66 open to the atmosphere is a tank type defoaming device having an ultrasonic oscillator 78 and a heat exchanger 79 at the bottom of or around an ultrasonic tank 76, and the ultrasonic tank 76 is open to the atmosphere. The coating liquids in the ultrasonic tank 76 are raised in temperature by the heat exchanger 79 and slowly stirred by a stirrer 80 to facilitate deaeration of the coating liquids. In this ultrasonic defoaming device 66 open to the atmosphere, coating liquids in the ultrasonic tank 76 are irradiated with ultrasonic waves to foam the air therein and the resultant bubbles are grown and clustered to make them float up to the liquid surface and thereby expelled. In this case, it is preferable for the frequency of ultrasonic oscillator 78 to be within a range of 20 KHz to 100 KHz.

The coating liquids defoamed by the ultrasonic defoaming device 66 open to the atmosphere are delivered to the heat exchanger 72 via the liquid feed pump 68 and the filter 70. The coating liquids are adjusted in temperature within the range of 25° C. to 40° C. by the heat exchanger 72, and supplied to the coating head 24. The temperature adjustment by the heat exchanger 72 is appropriately done according to the type of coating liquids.

At the stage following the heat exchanger 72, a flowmeter 81 and a bubble detector 82 are disposed, and bubbles in the coating liquids are measured by the bubble detector 82. As the bubble detector 82, what irradiates the coating liquids flowing in the liquid feed piping 64, converts the resultant variations in acoustic impedance in the sound field into electrical impedances of an ultrasonic vibrator, and outputs these variations from the bubble detector as electrical signals to enable the number of bubbles in the coating liquids to be suitably used.

Materials for use as the supporting base 14 the present invention include paper, plastic film, metal, resin-coated paper and synthetic paper. Materials usable for the plastic film include polyolefins such as polyethylene and polypropylene, vinyl polymers such as vinyl polyacetate, vinyl polychloride and polystyrene, polyamides such as 6, 6-nylon and 6-nylon, polyesters such as polyethylene terephthalate and polyethylene-2, 6-naphthalate, and cellulose acetates such as polycarbonates, cellulose triacetate and cellulose diacetate. Resins usable for resin-coated paper typically include polyolefins such as polyethylene, but are not limited to these. An example of metallic supporting base would be made of aluminum.

EXAMPLES

Examples of the invention will be described below, but the invention is not limited to these examples.

Example

This example of the invention is a case in which multiple layers of coats are formed over the supporting base 14 in a sequence from the bottom including a thermosensitive layer, a light reflecting layer and a protective layer, and the light reflecting layer contains PVA and boric acid which undergo a thermal reversible film hardening reaction. The dispensation of the respective coating liquids of the thermosensitive layer, the light reflecting layer and the protective layer, the liquid feed conditions of the coating liquids on the liquid feed line 60, the conditions of the application of coating liquids to the supporting base 14 by the coating head 24, the setting conditions of the multi-layer coats having been applied onto the supporting base 14 and the drying conditions will be described.

<Dispensation of Capsule Liquid Containing Dye Precursors>

As the dye precursors 6.3 g of 2-anilino-3-methyl-6-N-ethyl-N-sec-butyl aminofluoran (product of Nippon Soda Co.; the trade name of PSD184) and 1.9 g of 3-(1-ethyl-2-methylindole-3-il)-3-(4-diethylamino-2-methylphenyl)-4-azaphthalidetaken ate (product of Yamada Chemical Co.; the trade name of Blue 220), as the ultraviolet absorber 5 g of 2-(5-t-butyl-2-hydroxyphenyl) benzotriazol (product of Ciba-Geigy: the trade name of Tinuvin PS) and as the wall material 12 g of Takenate D110N (product of Takeda Pharmaceutical Co.) were dissolved in 20 g of aromatic petroleum solvent diisopropyl naphthalene (product of Kureha Corporation; the trade name of KMC113) and 12 g of ethyl acetate. This solution was mixed with 75 g of a 10 wt % aqueous solution of polyvinyl alcohol (product of Kuraray; the trade name of PVA-205, 88% saponified), emulsified at 8000 rpm for five minutes with Ace Homogenizer (product of Nippon Seiki Co.) and, with 60 g of water and 0.5 g of tetraethylene pentamin further added, reacted at 50° C. for three hours to prepare a capsule liquid of 0.7 μm in capsule size.

<Preparation of Developer-Dispersed Liquid>

60 g of 1,3-bis [2'-(p-hydroxyphenyl)2'-propyl] benzene (product of Mitsui Chemicals; the trade name of Bisphenol M) was dispersed in 7 g of polycarbonic acid of 25% concentration (product of Kao Corp.; the trade name of Demol EP) and 140 g of an aqueous solution of 5% partially saponified polyvinyl alcohol of 5% concentration (product of Kuraray; the trade name of PVA-205), and crushed with a sand mill to prepare a developer-dispersed liquid of 0.6 μm in average grain size.

<Preparation of Pigment-Dispersed Liquid for Light Reflecting Layer>

50 g of titanium oxide (product of Ishihara Sangyo Kaisha; the trade name of R780-2) was dispersed in 0.6 g of polycarbonic acid of 25% concentration (product of Kao Corp.; the trade name of Demol EP) and 70 g of an aqueous solution of 8 wt % polyvinyl alcohol (product of Kuraray; the trade name of PVA-205, 88% saponified), and crushed with a sand mill to prepare a pigment-dispersed liquid of 0.35 μm in average grain size for the light reflecting layer.

<Preparation of Pigment-Dispersed Liquid for Protective Layer>

50 g of aluminum hydroxide (product of Showa Denko; the trade name of Higilite H42) and 3 g of stearic zinc (product of Sakai Chemical Industry; the trade name of SZ2000) were dispersed in 2 g of an aqueous solution of sodium hexamethaphosphate of 40% concentration and 70 g of an aqueous solution of 4wt % polyvinyl alcohol (product of Kuraray; the trade name of PVA-205, 88% saponified), and crushed with a sand mill to prepare a pigment-dispersed liquid of 0.6 μm in average grain size for the protective layer.

By using the capsule liquid and dispersed liquids prepared as described above, coating liquid for the thermosensitive recording layer, coating liquid for the light reflecting layer and coating liquid for the protective layer were dispensed in the following manner.

[Dispensation of Coating Liquid for Thermosensitive Recording Layer]

35 g of the dye precursor-containing capsule liquid, 15 g of the developer-dispersed liquid and 0.1 g of 50 wt % fluorescent whitening agent (product of Nippon Kayaku; the trade name of Kayaphor S) were mixed. As a thickener, 2.5 g of 1 wt % CMC (product of Dai-ichi Kogyo Seiyaku; the trade name of Serogen EP) was added thereto, water was further added thereto adjust the solid concentration to 32%, and the coating liquid for the thermosensitive recording layer was obtained. The viscosity of this coating liquid for the thermosensitive recording layer was 150 mPa-S, and its pH, 7.7.

[Dispensation of Coating Liquid for Light Reflecting Layer]

80 g of the pigment-dispersed liquid for the light reflecting layer, 215 g of 15 wt % polyvinyl alcohol (product of Kuraray; the trade name of PVA-205, 88% saponified) and 25 g of 4 wt % boric acid were mixed. Hydrochloric acid was added to this mixture to adjust the pH to 6.1, water was further added. thereto adjust the solid concentration to 20%, and the resultant liquid was used as the coating liquid for the light reflecting layer. The viscosity of this coating liquid for the light reflecting layer was 450 mPa-s and its surface tension, 36 mN/m. This coating liquid for the light reflecting layer contains PVA and boric acid which undergo a film hardening reaction.

[Dispensation of Coating Liquid for Protective Layer]

The pigment-dispersed liquid for the protective layer in a weight of 115 g, 1.5 g of 50 wt % fluorescent whitening agent (product of Nippon Kayaku; the trade name of Kayaphor PAS), 35 g of an aqueous solution of 10 wt % polyvinyl alcohol (product of Kuraray; the trade name of PVA-217, 88% saponified) and 5 g of 10 wt % dodecyl benzene sulfonic acid were mixed to obtain the coating liquid for the protective layer. The viscosity of this coating liquid for the protective layer was 350 mPa-S, its pH, 8.2 and its surface tension, 33 mN/m.

[Temperature Adjustment of Coating Liquids and Liquid Feed]

The coating liquid for the thermosensitive recording layer was kept at a temperature of 25° C. in the liquid feed tank 62, and raised in temperature to 33° C. by the ultrasonic defoaming device 66, having an insulating function, and the heat exchanger 72 disposed in the liquid feed piping 64 leading to the coating head 24. The coating liquid for the light reflecting layer and the coating liquid for the protective layer were kept at a temperature of 35° C. in the liquid feed tank 62, and their temperature was controlled by the ultrasonic defoaming device 66, having an insulating function, and the heat exchanger 72 disposed in the liquid feed piping 64 to be 33° C. when they would reach the coating head 24.

And the coating liquid for the thermosensitive recording layer, the coating liquid for the light reflecting layer and the coating liquid for the protective layer dispensed as described above were applied, set and dried in the following manner.

[Application of Thermosensitive Recording Material]

The multi-layer coats were formed, in the sequence of the thermosensitive recording layer, the light reflecting layer and the protective layer from the bottom, on one face of the transparent PET supporting base 14 of 75 m in thickness with the slide bead coating device 16. The solid concentrations of the thermosensitive recording layer, the light reflecting layer and the protective layer at the time were respectively 32 wt %, 18 wt % and 32 wt %, and coats were applied at a velocity of 10 m/minute so that their respective solid weights would become 10.0 g/m$^2$, 4.0 g/m$^2$ and 2.0 g/m$^2$. And warm water of 32° C. was let pass the hollow 52 of the coating head 24, and the temperature was so controlled as to keep the whole coating head 24 at a uniform temperature. The temperature-humidity of the coating chamber then was 25° C./60% RH, and the temperature of the supporting base 14 was 24° C.

[Setting and Drying of Thermosensitive Recording Materials]

Next, the supporting base 14 on which the multi-layer coats were formed was let run in the set zone device 18, and the multi-layer coats were set at 15-second intervals in an environment of 20° C. After that, they were dried in the drying device 20, in the first drying zone 20A with a dry air flow adjusted to 40° C. until the water content of the multi-layer coats became 80% or less of the level at the time of coat application, followed by being dried for 20 seconds with a hot air flow of 50° C. in the second drying zone 20B and for 20 seconds with a hot air flow of 80° C. in the third drying zone 20C, and further by being dried for 20 seconds with a hot air flow of 50° C. in the fourth drying zone 20D. This procedure resulted in the thermosensitive recording material of this example.

The thermosensitive recording material that. was obtained as a result was free from inter-layer mixing, and found excelling in both coloring performance and image quality.

Comparative Example 1

Comparative Example 1 was carried out under the same conditions as Example 1 except that drying was started by blowing a hot air flow of 80° C. on the surface of multi-layer coats five seconds after the coating liquids were applied onto the supporting base 14 with the coating head 24.

The thermosensitive recording material that was obtained as a result involved no problem in coloring performance, but uneven printing due to inter-layer mixing was observed.

Comparative Example 2

This was carried out under the same conditions as Example 1 except that thermal insulation on the liquid feed line 60 and at the coating head 24 was not performed and coat application was performed with the coating head 24 to the thermosensitive recording layer, the light reflecting layer and the protective layer all at a temperature of 20° C.

As a result, the coating liquids so extremely increased in viscosity on the sliding face 44 of the coating head 24 that coat application could be no longer continued.

INDUSTRIAL APPLICATION

By the method of manufacturing information recording materials according to the invention, normal simultaneous multi-layer coating can be accomplished without allowing the coating liquids to increase in viscosity before and during their application, and inter-layer mixing can be prevented by increasing the viscosity after the application.

Therefore information recording materials manufactured by the information recording material manufacturing method according to the invention are less in material thickness, and information recording materials excelling in functions and performance can be obtained.

The invention claimed is:

1. A method of manufacturing an information recording material having a coating step of forming multi-layer coats, of which at least one out of a plurality of layers formed by simultaneous multi-layer application of a plurality of coating liquids over a running supporting base is an information recording layer, and a drying step of drying the multi-layer coats formed at the coating step, the method of manufacturing an information recording material being wherein:

at least one coating liquid out of the plurality of coating liquids contains a plurality of components which, when brought into contact or are mixed with each other, make the coating liquids increase in viscosity, the viscosity increase by the plurality of components is a film hardening reaction by polyvinyl alcohol (PVA) and boric acid, and the pH of coating liquids containing the polyvinyl alcohol (PVA) and the boric acid is 6.5 or less and the pH of the coating liquids of any layer adjacent to any layer formed of these coating liquids is 7 or more.

2. The method of manufacturing an information recording material according to claim 1, wherein the plurality of components react with each other and increase in viscosity by being brought into contact or mixed and the reaction is a thermal reversible reaction.

3. The method of manufacturing an information recording material according to claim 1, wherein the concentration of polyvinyl alcohol (PVA) relative to the coating liquids is in the range of 3 to 20 wt % and the concentration of the boric acid is in the range of 0.5 to 10 wt % relative to the polyvinyl alcohol (PVA).

4. The method of manufacturing an information recording material according to claim 1, wherein the polyvinyl alcohol (PVA) is partly saponified.

5. The method of manufacturing an information recording material according to claim 1, wherein the viscosity of coating liquids containing the polyvinyl alcohol (PVA) and the boric acid and the viscosity of any layer adjoining the layers formed of these coating liquids at the liquid temperature at the time of applying the coating liquids are 50 mPa-s or more.

6. The method of manufacturing an information recording material according to claim 1, wherein the coating liquids containing the polyvinyl alcohol (PVA) and the boric acid are applied with their liquid temperature kept at 25° C. to 45° C.

7. The method of manufacturing an information recording material according to claim 1, wherein the process of the simultaneous multi-layer application is a slide bead coating process.

8. The method of manufacturing an information recording material according to claim 7, wherein the coating head of the slide bead coating process is kept at a temperature of 25° C. to 45° C.

9. The method of manufacturing an information recording material according to claim 1, wherein a setting step to keep the temperature of the multi-layer coats below 25° C. for five seconds or more is provided between the coating step and the drying step.

10. The method of manufacturing an information recording material according to claim 1, wherein the temperature of the multi-layer coats is kept at 45° C. or below until the water content in the multi-layer coats falls to 80% or below of the level at the time of coat application.

11. The method of manufacturing an information recording material according to claim 1, wherein the temperature of the coating liquids is kept at or above 25° C. before and during the application thereof, and the temperature of the coating liquids is lowered to below 25° C. after the application thereof.

* * * * *